United States Patent [19]

Chiari et al.

[11] 3,992,866

[45] Nov. 23, 1976

[54] DOFFING MECHANISM FOR SPINNING AND TWISTING FRAMES

[75] Inventors: Natale Chiari; Valerio Calabria; Giuseppe Inverardi, all of Cologne Bresciano (Brescia), Italy

[73] Assignee: Edera Officina Meccanica Tessile S.p.A., Milan, Italy

[22] Filed: Nov. 3, 1975

[21] Appl. No.: 628,238

[30] Foreign Application Priority Data

Jan. 9, 1975 Italy ..... 19124/75

[52] U.S. Cl. ..... 57/53

[51] Int. Cl.[2] ..... D01H 9/10

[58] Field of Search ..... 57/34 R, 52, 53, 54; 242/18 PW

[56] References Cited

UNITED STATES PATENTS

| | | | |
|---|---|---|---|
| 3,566,597 | 3/1971 | Para | 57/53 |
| 3,696,602 | 10/1972 | Olson et al. | 57/53 |
| 3,854,275 | 12/1974 | Bethea et al. | 57/53 X |
| 3,908,348 | 9/1975 | Hirschle et al. | 57/53 |

FOREIGN PATENTS OR APPLICATIONS

| | | | |
|---|---|---|---|
| 24,515 | 1/1963 | Germany | 57/53 |

*Primary Examiner*—Donald E. Watkins
*Attorney, Agent, or Firm*—Haseltine, Lake & Waters

[57] ABSTRACT

A bobbin doffing mechanism for spinning and twisting frames is disclosed, the improvement consisting in that a plurality of fluid-controlled doffing units is mounted on a generally elliptical race so that the spindle line is arranged along a rectilinear path of the race, the opposite rectilinear path being opposite to the spindle line. The plurality of doffing units travel in a closed loop on the generally elliptical path. The doffing units comprise gripping members for doffing and discharging the bobbins, these units being fluid-controlled, preferably pneumatically controlled, the sequence of operations being commanded by a specially provided cam mechanism.

6 Claims, 11 Drawing Figures

DOFFING MECHANISM FOR SPINNING AND TWISTING FRAMES

This invention relates to a doffing mechanism for spinning and twisting frames.

The device according to the invention is mainly characterized in that it comprises a carriage which can be rectilinearly displaced from one end to the other of a spindle front, said carriage comprising a base frame, an array of gripping members which are normally maintained in a lifted position relative to the spindle front and can be displaced horizontally and all together relative to the base frame at a relative speed equal to the speed of the carriage with respect to the spindle front so as to go along a substantially elliptical path having two longitudinal branches parallel to the spindle front, one of which is nearer to the spindle front and having a motion which is not concordant with that of the carriage and the other of which is farther from the spindle front and has a motion which is concordant with that of the carriage, and control means sequentially to cause the fall in the open condition, the closure and the ascending motion of the gripping members along the nearside branch of their path for doffing the yarn bobbins from the relative spindles and for temporarily opening the gripping members along the farther branch of the same path for discharging the doffed bobbins.

The prominent advantage of the device according to the invention is that, due to the combination of the motions of the carriage with respect to the spindle front and of the gripping members with respect to the base frame of the carriage, both the carriage and the gripping members can be continually translated without those periodical stoppages which, in the conventional devices, are essential to allow the gripping members to fall to the level of the bobbins to be doffed and, while remaining stationary relative to the spindles, to be closed and to ascend again with the doffed bobbins.

In the device according to the invention these stoppages are unnecessary since the above indicated combination of motions acts in such a way that the gripping members, for their being driven with two discordant motions having the same velocity, remain stationary with respect to the spindles while they are running along their elliptical path in the branch where their descent is provided for as well as the doffing stroke. In the device according to the invention there are thus reliably provided the same operation conditions of the conventional devices but without the stoppages of the advance motion which proved to be heretofore detrimental both from the point of view of the intricacy of the advancing assembly and that of the overall operation speed.

Additional features and advantages of the present invention will clearly appear from the ensuing detailed description of a preferred embodiment thereof as shown by way of example in the accompanying drawings, wherein.

Figure 1:
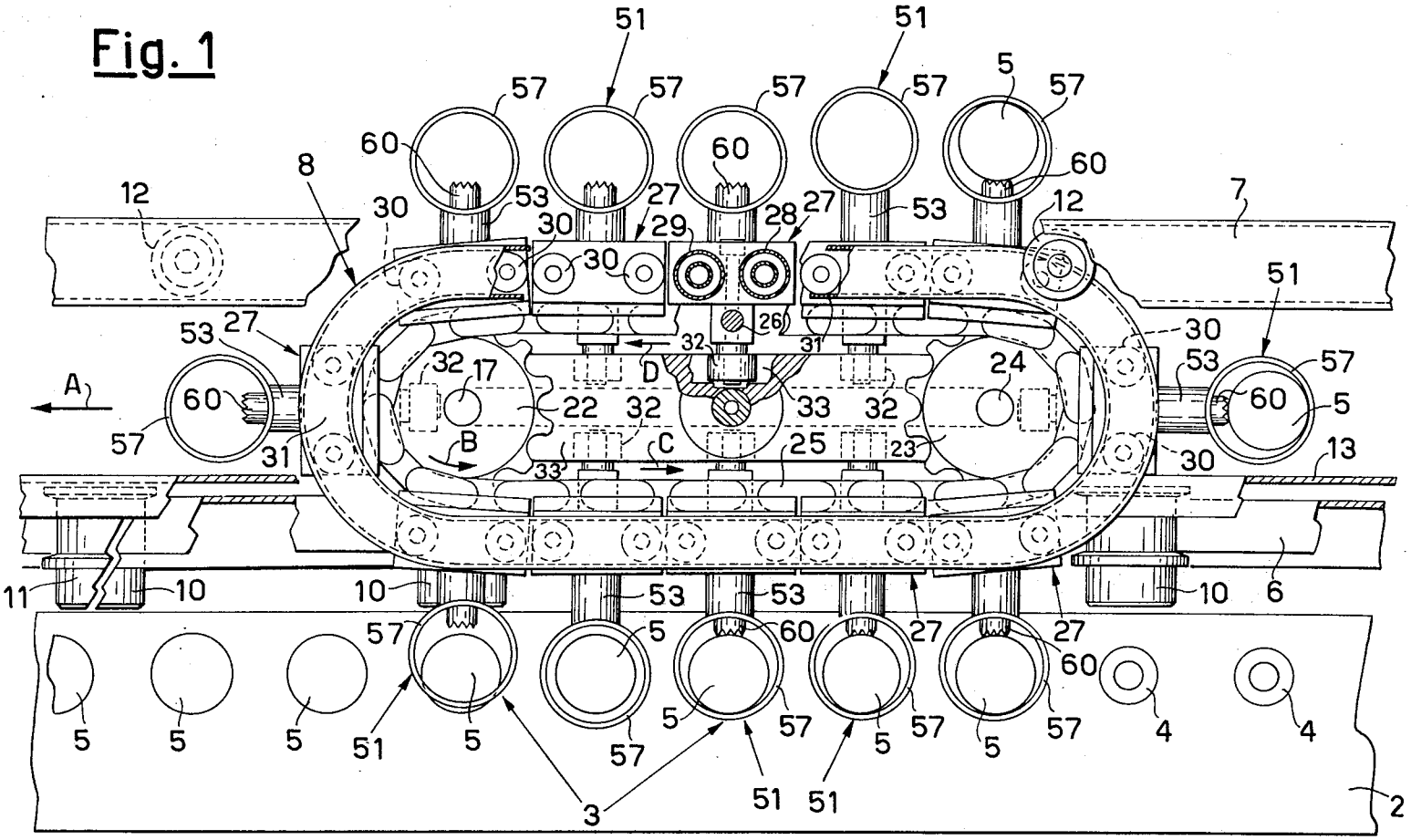
FIG. 1 is a plan view, with a few component parts in cutaway and in cross-section, of said preferred embodiment of the device according to the invention.
Figure 2:
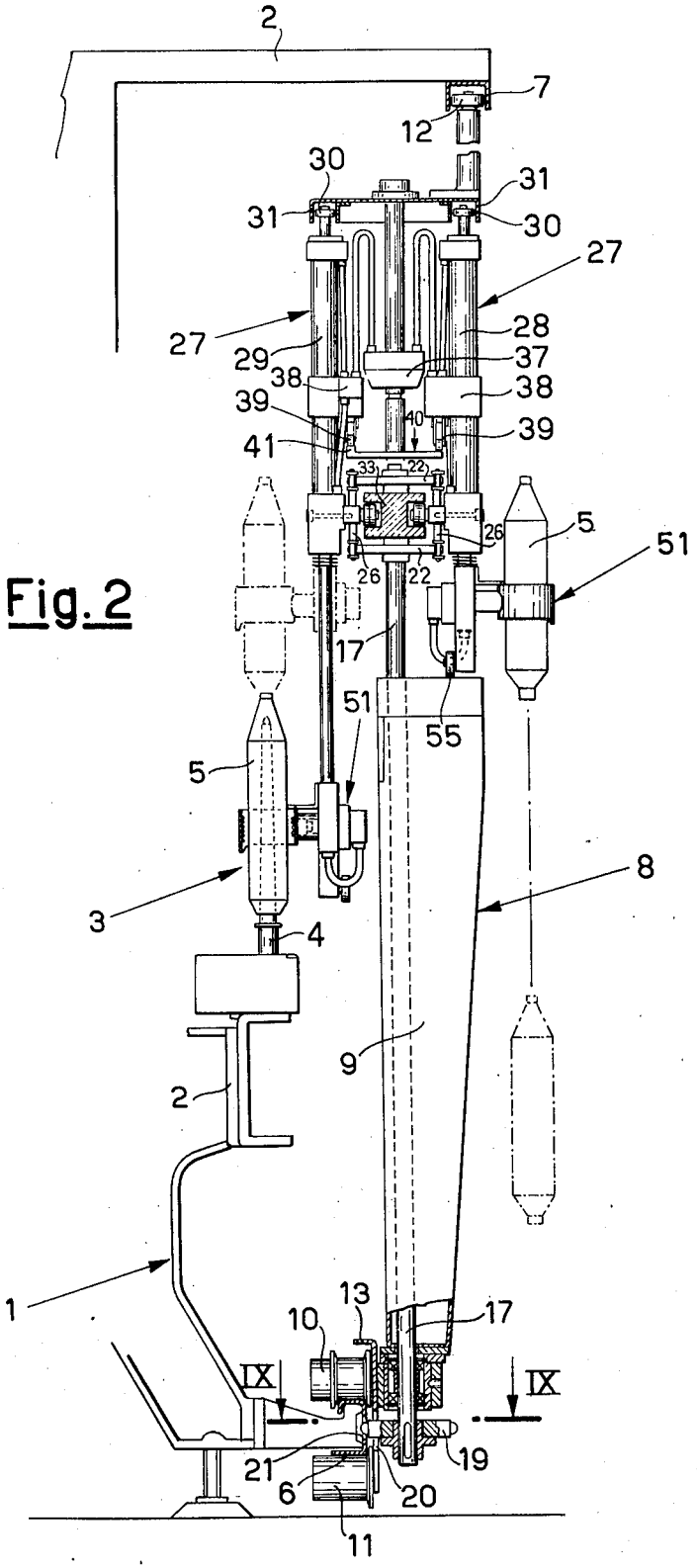
FIG. 2 shows the device of FIG. 1 as a side elevational view, some parts being shown in cross-section.
Figure 5:
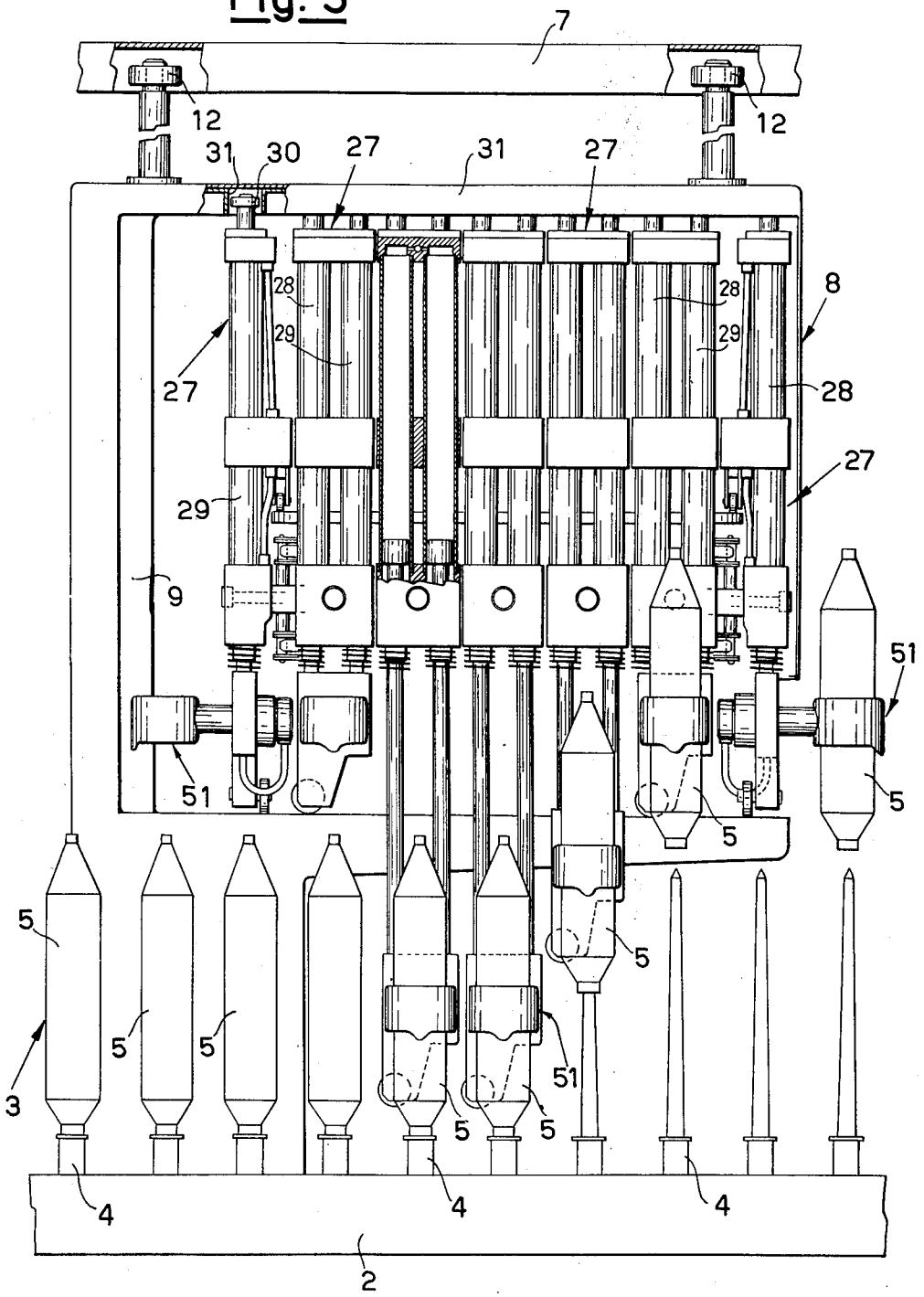
FIG. 5 shows the top portion of said device as viewed from the left side with respect to FIG. 2.

The device as shown in the drawings is considered as having been temporarily applied to a spinning of twisting frame 1 equipped with a fixed structure 2 which supports a spindle line 3 as formed by an array of rotatable spindles 4 on which yarn bobbins 5 are mounted (FIGS. 1, 2 and 5).

The fixed structure 2 of the machine 1 has two straight rails 6 and 7, one below and one above (FIG. 2) by which is guided, in a continuous rectilinear motion from one end to the other of the spindle line 3, a carriage 8 which makes up the device according to the invention.

The carriage 8 comprises a base frame 9 which is guided in its sliding motion from one end to the other of the spindle line 3 by the engagement of pairs of its bottom idle rollers 10 and 11 with the fixed bottom rail 6 and of its top idle rollers 12 with the fixed top rail 7 (FIG. 2). The rollers 10 and 11 are supported for rotation by a stirrup 13 fastened to the frame 9 (FIGS. 2 and 7).

Figure 7:
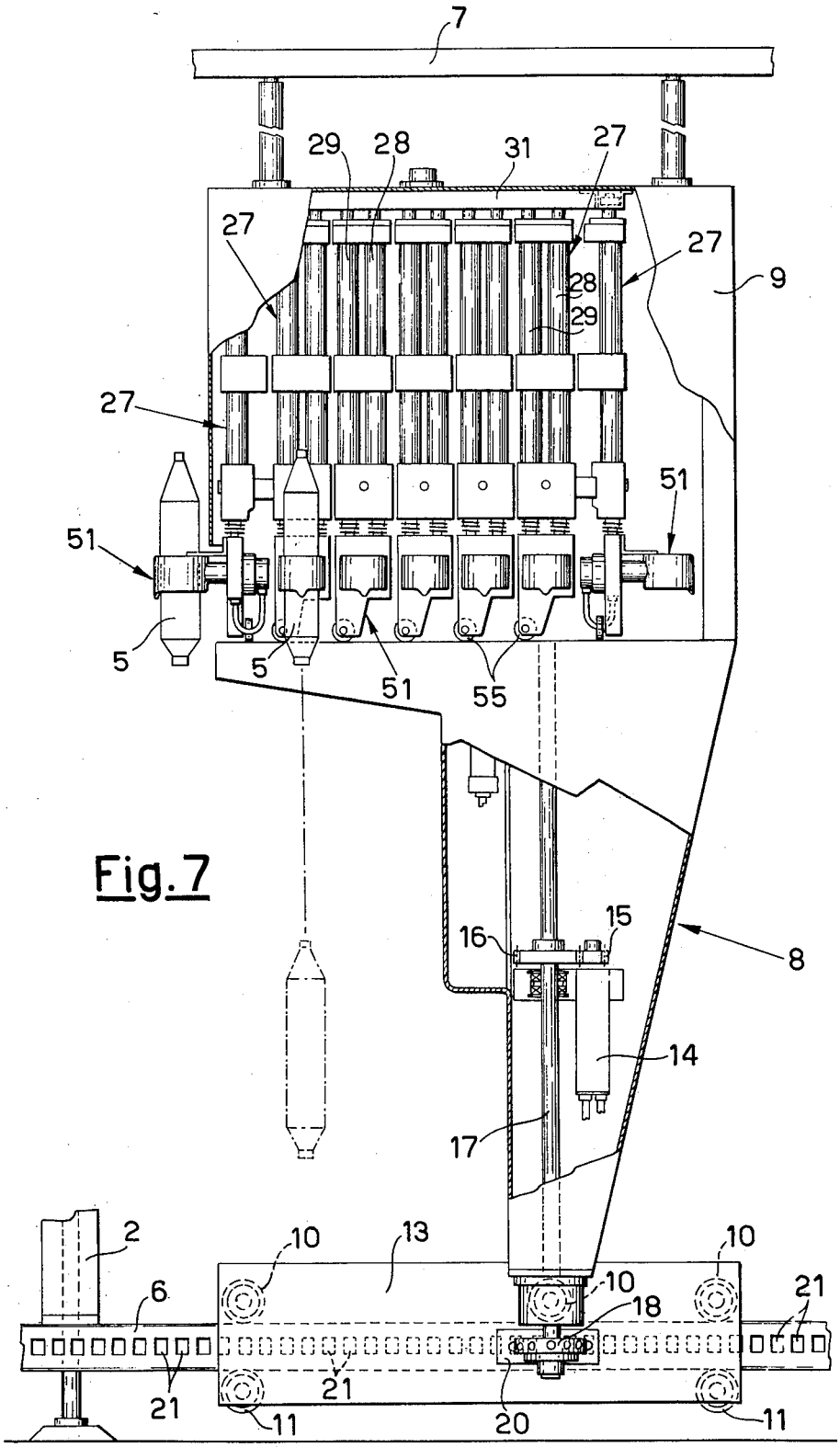
FIG. 7 shows, also with some component parts having been cut away, the same device as viewed from the right side with respect to FIG. 2.
Figure 9:
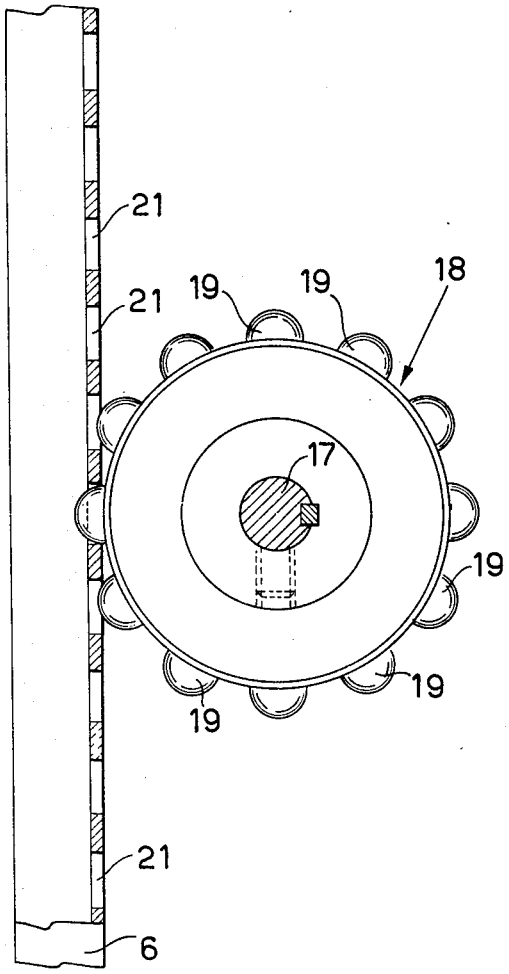
FIG. 9 shows in cross-sectional view taken along the line IX—IX of FIG. 2 the closeup detail of a gear couple which is intended for the advance of the carriage from one end to the other of the spindle front of the machine in which it is mounted.

The carriage 8 is caused to advance in a continuous way in the direction of the arrow A of FIG. 1 by a driving unit which comprises a pneumatic prime mover 14, a two-gear drive 15–16, an arbor 17 supported for rotation by the base frame 9 and a gear 18 affixed to the bottom end of the arbor 17 and equipped with hemispherical teeth 19 (FIG. 9) engaging through a window 20 of the stirrup 13 with a sort of rack as built up by a line of windows 21 formed through the rail 6 (FIGS. 2, 7 and 9).

Figure 3:
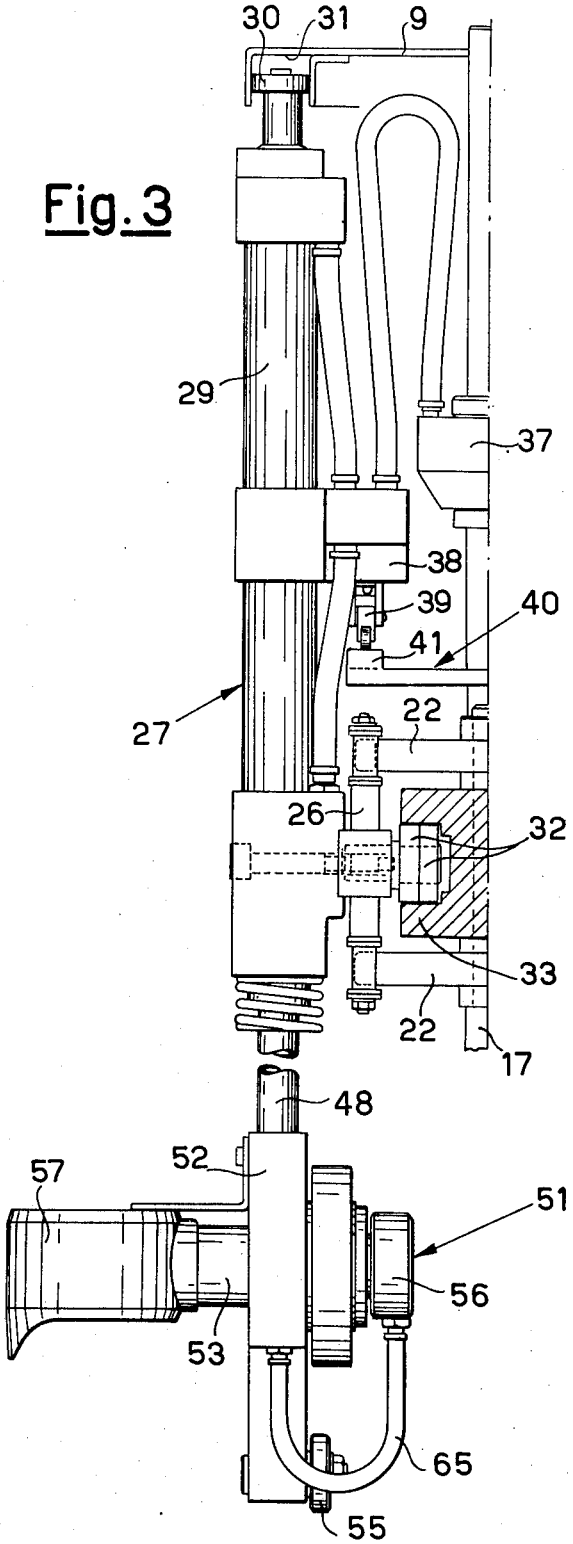
FIG. 3 is a closeup view of the device in the same position as in FIG. 2.
Figure 6:
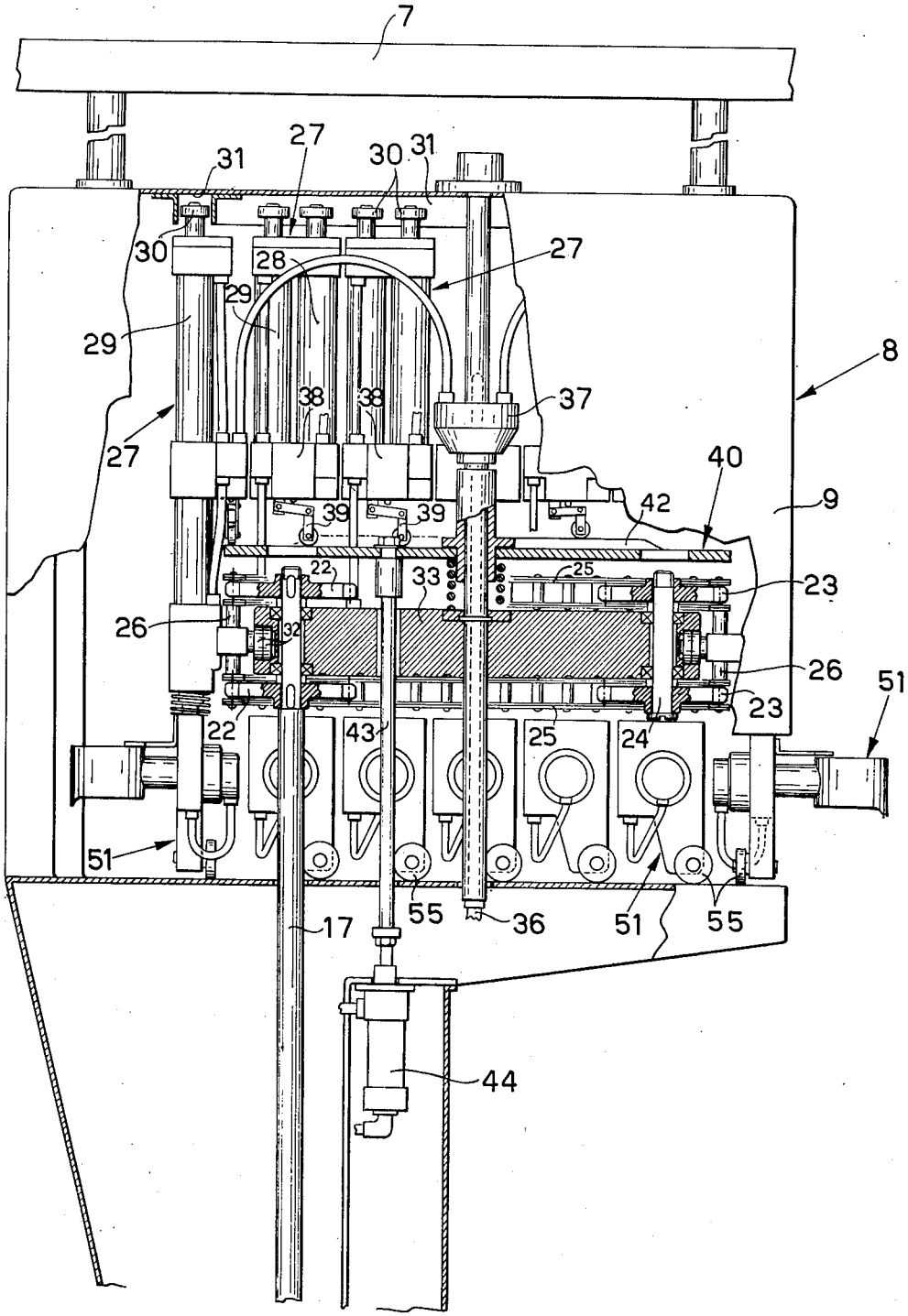
FIG. 6 shows the same top portion in cross-sectional view in such a way as to show the rear portion of the device in question.

To the top end of the arbor 17 two gears 22 are affixed (FIG. 2), to which is coupled a corresponding pair of gears 23 as affixed to an idle arbor 24 which is carried by rotation by the base frame 9 (FIG. 6). The two pairs of integral gears 22 and 23 are coupled together by a corresponding couple of chains 25 (FIGS. 1 and 6), which are occasionally held together by an evenly staggered succession of bars 26 (FIGS. 2, 3 and 6), each of which has affixed thereto corresponding couple of integral cylinders 27 as formed by two parallel pneumatic rams 28 and 29 (FIGS. 1, 4, 6, 6 and 7). The two chains 25 are then associated with a succession of couples of cylinders 27, which are driven by the rotary motion imparted by the arbor 17 to the gear 22 (surface B of FIG. 1) and then to the chains 25, so as to move with a continuous motion along a substantially elliptical path (FIG. 1) which comprises two parallel horizontal branches, one of which nearer to the spindle front 3 and with a motion discordant (arrow C of FIG. 1) with respect to that of the carriage 8 and the other farther from th spindle line 3 and with a motion which is concordant (arrow D of FIG.1) with respect to the carriage 8. In said motion the pairs of cylinder 27 are guided by the engagement of respective pairs of rollers 30 in a top elliptical guide 31 (FIGS. 1, 2) and of respective pairs of rollers 32 in a bottom elliptical guide 33 arranged between the chains 25 (FIGS. 2, 3 and 6).

Figure 8:
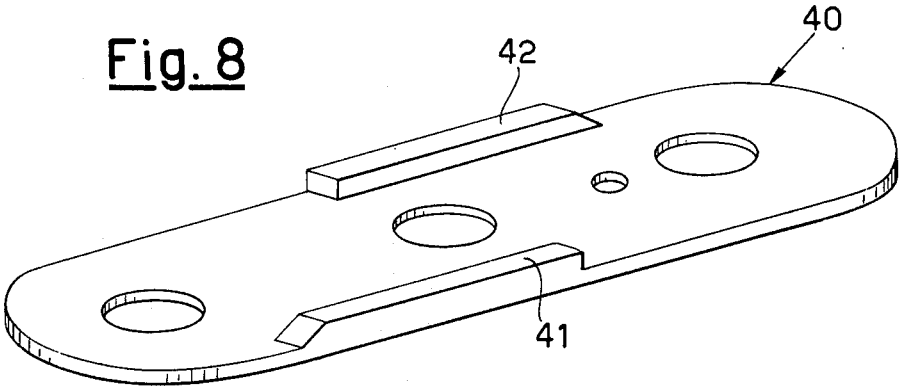
FIG. 8 shows in perspective view the closeup detail of a control cam for the actuation of the gripping members included in the device of FIGS. 1 to 7.

As already outlined above, each pair of cylinders 27 is formed by two parallel pneumatic rams solid with one another, 28 and 29. These cylinders are fed in parallel through upper and lower ports 34 and 35 common to both cylinders, these ports being controlled, in the sense of being placed in alternate communication one with the outlet and the other with a source of compressed air 36 via a freely rotating distributor 37 (FIG. 6) and then vice versa, by the agency of a pneumatic valve 38 (solid with the pair of cylinders 27) which is equipped with a control lever 39 cooperating with a fixed elliptical cam 40 (FIG. 8) equipped with two lands 41 and 42 (adapted to cause the connection of the ports 35 to the outlet) and normally maintained in the operative position of the FIGS. 2, 3 and 6 by a rod 43 as controlled by a pneumatic ram 44 (FIG. 6).

Figure 4:
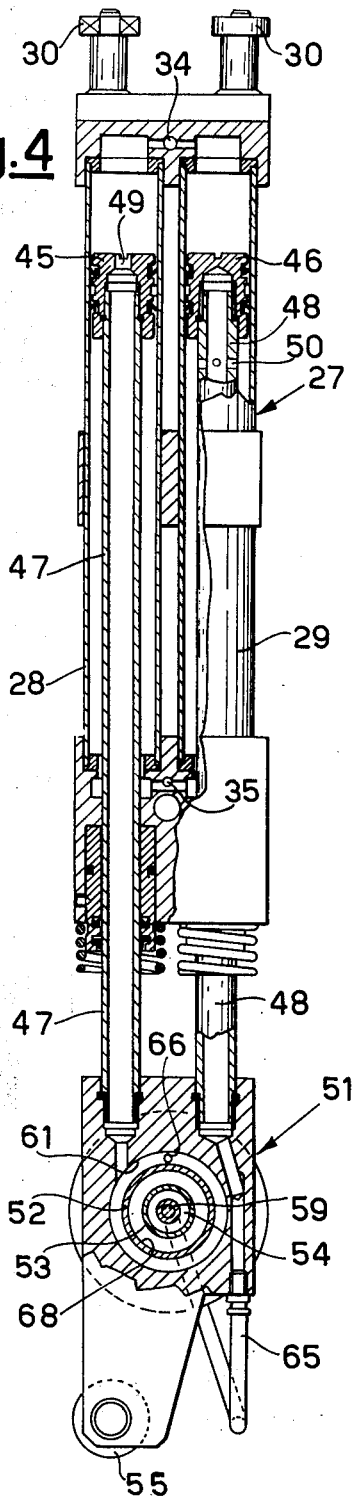
FIG. 4 shows the same closeup view of FIG. 3 but as viewed from the left side and partly in cross-sectional view.

In the two cylinders 28 and 29 of each couple of integral cylinders 27 there are housed for sliding the respective double-acting pistons 45 and 46 equipped with respective hollow stems 47 and 48, the inner hollow spaces of which are in connection with the upper chamber of the cylinder 28 and the lower chamber of cylinder 29, respectively, via the respective passageways 49 and 50 (FIG. 4).

Figure 10:
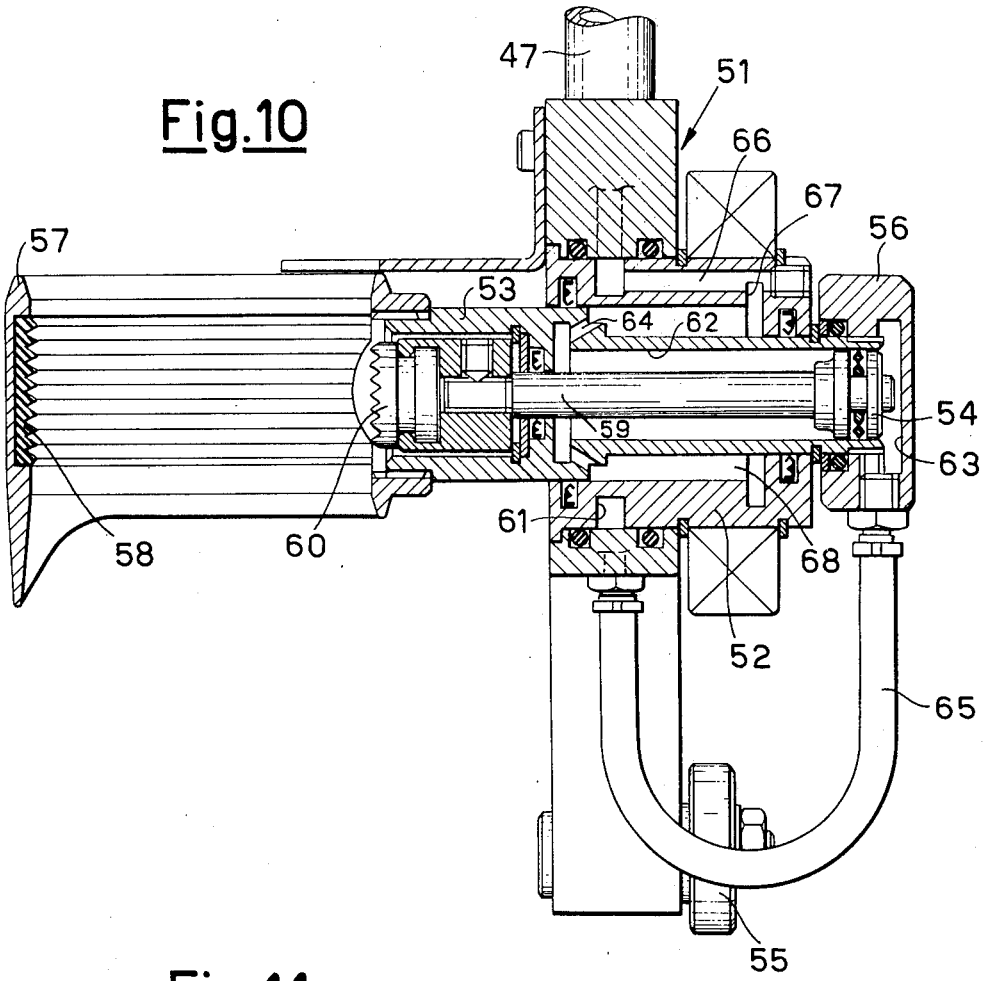
FIG. 10 is a longitudinal vertical cross-sectional view the closeup detail of one of the gripping members of the device of FIGS. 1 to 7, when viewed in the open position.
Figure 11:
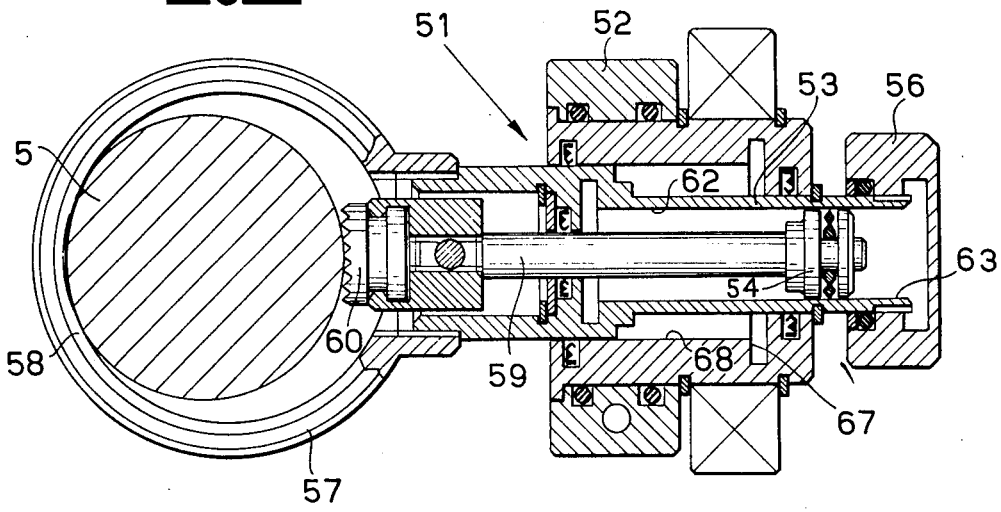
FIG. 11 is a horizontal longitudinal cross-sectional view of the same gripping member when it is in the closed position.

To the lower ends of each couple of hollow stems 47 and 48 there is affixed a respective gripping member 51, which, as shown in FIGS. 3, 4, 10 and 11, comprises three coaxial members 52, 53 and 54, the first of which is a fixed body with a lower extension equipped with a follower 55 (FIGS. 3, 4 and 10), the second one is a basically cylindrical body which is made integral with a rear extension 56 and, at the opposite end, with a ring 57, the latter being partially coated by an internal rubber lining 58 (FIG. 10) while the third coaxial member is a double-acting piston having a stem 59 to which a presser head 60 (FIGS. 10 and 11) which can be introduced in the ring 57 (FIG. 11). Between the two coaxial bodies 52 and 53 an annular chamber 68 is formed, which, through passageways 67 and 66 is in communication with an outermost chamber 61, the latter being, in its turn, in communication with the inner cavity of the stem 47 (FIGS. 4 and 10), whereas between the cylinder 53 and the piston 54 two chambers 62 and 63, are defined, the first of which is in communication with the annular chamber 68 via passageways 64 and the second is in communication with the internal cavity of the stem 48 through a flexible duct 65 (FIGS. 4 and 10).

The doffing mechanism as shown in the drawings operates as follows. While the engagement existing between the gear 18 and the rack-rail 6 (FIGS. 2, 7 and 9) impresses a continuous rectilinear motion to the carriage 8 along the rails 6 and 7 from one end to the other of the spindle line 3 (arrow A of FIG. 1), the chains 25 impress to the couples of pneumatic cylinders 27, relative to the base frame 9 of the carriage, a motion evolving along a substantially ellipctical path along the rails 31 and 33, the speed of which is the same as that of the carriage and the direction of which is not concordant with that of the carriage along the branch which is nearer to the spindle line (arrow C of FIG. 1) and is concordant with the motion of the carriage along the branch which is farther from the spindle line (arrow D of FIG. 1). Consequently, the couples of clyinders 27, even being movable with respect to the carriage base frame are stationary relative to the spindle line 3 during the whole period of time in which they go along the nearside branch of the elliptical path under the control of the chains 25. The couples of cylinders 27, conversely, are moved at a double speed as they go along the opposite branch.

Each couple of cylinders 27 is then arrested relative to the spindle line, more exactly in front of a respective bobbin 5 (FIGS. 1 and 5) at the beginning of its elliptical path. At this stage the feeler lever 39 of the control valve 38 abuts and engages the embossed portion of the cam 40 (let it be assumed that the cam of FIG. 8 be justaposed to the plan view showing of FIG. 1), so that the lower port 35 (FIG. 4) is connected to the outlet and, conversely, the upper port 34 is being fed. Air under pressure passes then into the upper chambers of the two coupled cylinders 28 and 29, but, initially, it does not impress any efficient downward thrust upon the pistons 45 and 46 inasmuch as, in the first place, it flows through the hole 49 into the inner space of the stem 47 (FIG. 4) and thence, via the passageway 61, 66 and 67, into the annular chamber 68 and, therefore, via the passageways 64, into the chamber 62, where it unfolds upon the piston 54 and the opposite wall of the cylinder 53 in action tending to cause the complete opening of the gripping member 51 (FIG. 10), the ring 57 of the latter thus becoming coaxial with the bobbin 5 to be doffed (FIG. 1).

During the initial stage of the motion of the pair of cylinders along the nearside branch of its elliptical path, only the complete opening of the gripping member 51 is effected, but its fall is not. The latter operation takes place immediately after, however, when, once the opening has been fully completed, the air under pressure as fed into the upper chamber of the cylinders 28 and 29 is thoroughly applied to the pistons 45 and 46, which go down as an entity together and bring the ring 57 of the gripping member astride the bobbin 5 in front of which the couple of cylinders in question has been arrested (FIGS. 2 and 5).

The assembly remains in these conditions until the feeler lever 39 of the control valve 38 abuts the terminal portion of the embossed component part 41. At this stage the condition of the ports 34 and 35 is reversed, in the sense that the former is connected to the outlet, whereas the latter is fed with compressed air. Again, no air is applied immediately to the pistons 45 and 46, but first flows through the ports 50, the inner cavity of the stem 48 and the flexible duct 65 until reaching the chamber 63, from which, first it thrusts forward the piston 54 until the pressing head 60 engages the bobbin 5, the latter having already been introduced in the ring 57 and then, since the piston 54 cannot be further displaced, it acts upon the opposite wall of the extension 56 of the cylinder 53 so as to push back the ring 57 until the latter pressurally engages the bobbin 5 on the side away of the engagement area with the presser head 60 (FIG. 11). The bobbin 5 is thus gripped with balanced forces which act concurrently upon two opposite sides of the bobbin concerned (FIG. 1).

As soon as the closure of the gripping member has been completed and the bobbin is now firmly held, compressed air as fed through the lower port 35 can be entirely active upon the lower surfaces of the pistons 45 and 46, these latter being thus thrust upward, and the gripping member 51 is now permitted to doff the bobbin 5 seized thereby and taken out of its spindle 4 (FIGS. 2 and 5).

All the operations as described above take place, as aforesaid, when the cylinders are stationary with respect to the spindle line, even though they are movable relative to the carriage, the latter being, in its turn, in a direction which is opposite to the spindle line. All the descent, gripping and lifting operations are only due to the different action the cam 40 impresses, via the valve 38, to the cylinders 28 and 29.

As soon as the couple of cylinders which has just completed the bobbin grasping reaches the end of the branch of its elliptical path which is nearer to the spindle line, the sum of the motions impressed thereto is no longer nil and first it is increased to a valve of the velocity which is equal to that of the carriage (this is the case of the couple of cylinders which is half-way in the curved path on the right as viewed in FIG. 1) and then is even doubled, whereafter it remains a constant, at the start of the rectilinear pathe opposite to its elliptical path. At this stage the lever 39 of the control valve 38 rises on the embossment 42 of the cam 40 and thus causes the upper port 34 of the cylinders 29 and 28 to be fed with air again. The gripping member 51 then is reopened and drops the as-seized bobbin to discharge (FIGS. 1, 2 and 7), whereas no fall of the pistons 45 and 46 takes place since this is prevented by the abutment which takes place, along the farside branch of the elliptical path, between the follower 55 placed at the lower end of the gripping member and a projection 69 of the base frame 8 (FIGS. 2, 6 and 7).

Lastly, as the lever 39 becomes clear of the emobossment 42 of the cam 40, the gripping member 51 is compelled to close and in this condition it does remain until a new doffing cycle is started: this latter takes place, in the stationary cylinder condition as before, when the couple of cylinders to which the gripping member is matched, is once again located at the start of the rectilinear path of its elliptical race which is nearer to the spindle front.

The sequence of operations which has now been described for one couple of cylinders takes place, of course, also for the subsequent couples, the result being that, while the carriage 8 effects a continuous motion run from one end to the other of the spindle line (whereafter it is provided so that it leaves the rails 6 and 7 and thus also the spinning or twisting frame it has just acted upon), the several gripping members 51 provide, in sequence, to doff the several bobbins 5 as they are near the spindle line and to discharge them as they are on the opposite side (FIG. 2).

On completion of the operation, it is possible to act upon the pneumatic cylinder 44 to lower the cam 40 and to clear it of the levers 39 of the valves 28.

What is claimed is:

1. A bobbin-doffing mechanism for spinning and twisting frames, characterized in that it comprises a carriage which can be rectilinearly displaced from one end to the other of a spindle line, said carriage including a base frame, a succession of gripping members normally maintained in the raised position relative to the spindle front and can be horizontally displaced as an entity with respect to the base frame at a relative speed equal to that of the carriage relative to the spindle front so as to go along a substantially elliptical path having two longitudinal branches parallel to the spindle line, one of which is nearer to the spindle line and has a motion non concordant with that of the carriage and the other farther from the spindle line and having a motion concordant with that of the carriage, and control means sequentially to cause the fall in the open condition, the closure and the ascending motion of the gripping members along the nearside branch of the path for taking the bobbins out of their spindles and the temporary reopening of the gripping members along the farside branch of the path for discharging the doffed bobbins.

2. A mechanism according to claim 1, characterized in that the control means comprise, for each gripping member, a couple of fluid-operated cylinders parallel and integral with one another equipped with respective double-acting pistons with integral stems carrying the gripping member, the latter including gripping means and at least two members movable relative to one another and displaceable between an open and a closed position of the gripping members, the piston stems having respective internal spaces which communicate, one with the top end of said cylinders and with a fluid-operating chamber of said members towards an opening position and the other with the bottom end of the cylinder and with a chamber for pushing said members under the action of a fluid towards said closure position, so that the feed of a compressed fluid into the top end of the cylinders tends to cause, first, the opening and then the fall of the gripping member and the feed of compressed fluid into the bottom end of the cylinders tends to cause first the closure and then the rising movement of the gripping member.

3. A device according to claim 2, characterized in that the members movable with respect to one another of the gripping members are a cylinder and a double-acting piston both movable with respect to a fixed body solid with the piston stems, one of these members having affixed thereto a ring which can be positioned around the bobbin to be doffed and the other of said members having affixed thereto a presser head which can be readially introduced in said ring so as to cooperate with the latter for seizing opposite sides of a bobbin, the fluid-fed actuating chambers being chambers of said cylinder which are located on opposite ends with respect to the piston.

4. A mechanism according to claim 2, characterized in that the feed of fluid in either end of the integral cylinders is controlled by a valve which is responsive to the position of the cylinders along the elliptical path.

5. A mechanism according to claim 5, characterized in that the couples of fluid actuated cylinders which are the control means for the several gripping members are fastened in an orderly sequence to at least one chain engaged by two ends gears, one of which is caused to rotate in attunement with the motion of the carriage.

6. A mechanism according to claim 1, substantially as hereinbefore described and illustrated in the accompanying drawings.

* * * * *